US005115788A

United States Patent [19]

Sasaki et al.

[11] Patent Number: 5,115,788

[45] Date of Patent: May 26, 1992

[54] SUPERCHARGING APPARATUS FOR INTERNAL COMBUSTION ENGINE

[75] Inventors: Junsou Sasaki; Hidefumi Fujimoto; Noriyuki Iwata, all of Hiroshima, Japan

[73] Assignee: Mazda Motor Corporation, Hiroshima, Japan

[21] Appl. No.: 557,746

[22] Filed: Jul. 26, 1990

[30] Foreign Application Priority Data

Jul. 28, 1989 [JP] Japan ..... 1-196112

[51] Int. Cl.[5] ..... F02B 33/36

[52] U.S. Cl. ..... 123/559.3; 123/564; 417/310; 418/201.2

[58] Field of Search ..... 123/559.3, 564; 417/310; 418/201.2

[56] References Cited

U.S. PATENT DOCUMENTS

| | | | |
|---|---|---|---|
| 2,519,913 | 8/1950 | Lysholm | 418/201.2 |
| 4,656,992 | 4/1987 | Oonaka et al. | 123/559.3 |
| 4,826,412 | 5/1989 | Kubo et al. | 123/564 |
| 4,991,562 | 2/1991 | Chujo | 123/564 |

*Primary Examiner*—Michael Koczo

*Attorney, Agent, or Firm*—Fleit, Jacobson, Cohn, Price, Holman & Stern

[57] ABSTRACT

A supercharging apparatus for an internal combustion engine includes a screw type supercharger having an inlet opening and an outlet opening. The supercharger is adapted to compress intake air for the engine in compression chambers between the openings when an electromagnetic clutch engages the supercharger with the crankshaft of the engine. The supercharging apparatus includes an intake air bypass passage for allowing the intake air to bypass the supercharger and a bypass control valve for closing the passage. The supercharger has a communication passage for allowing the two compression chambers to intercommunicate for relieving the compression chambers of the compression pressure therein. A controller allows the communication passage to relieve the compression pressure during the disengagement of the electromagnetic clutch and causes the bypass control valve to close the intake air bypass passage in association with the relief of the compression pressure by the communication passage.

17 Claims, 8 Drawing Sheets

SUPERCHARGING APPARATUS FOR INTERNAL COMBUSTION ENGINE

BACKGROUND OF THE INVENTION

This invention relates to a supercharging apparatus for an internal combustion engine. More specifically, this invention relates to such a supercharging apparatus in which intake air for to the engine is compressed on its way from an inlet of an air intake system to an outlet thereof.

A variety of superchargers are generally used for internal combustion engines. In recent years, screw type superchargers have been used because they enhance of the volumetric efficiency and the possibility of improving overall adiabatic efficiency. In a case where such a type of supercharger is arranged in an air intake system of an engine and is used for compressing the intake air, it is necessary to relieve or reduce the pumping loss of the supercharger because the supercharger causes a relatively large pumping loss at low or partial load operating conditions of the engine.

Conventionally, under these circumstances, the supercharger is connected to drive means for the supercharger through an electromagnetic clutch, and the clutch is released when the supercharging effect is not required, so that the supercharger is not being driven. This kind of supercharger, however, has relatively large resistance to running during its non-driven state and is difficult to idle. Therefore, a torque shock due to an engagement of the electromagnetic clutch occurs as the clutch is changed from its disengagement to engagement states. To prevent such a torque shock, it is required to engage the clutch in a relatively low engine speed zone, even if the engine is not required to be supercharged in a low load operating condition. It follows that it is desirable to deactivate the compression action of the supercharger entirely, or to greatly relieve the compression action. If the compression action of the supercharger can be deactivated entirely or relieved greatly, advantages would be obtained. For instance, the torque shock due to the engagement of the electromagnetic clutch could be depressed and, therefore, the rotating speed engaging the clutch in the low load operating condition could be enhanced. This is brought about because the supercharger can idle during its non-driven state, and the significant differences between the rotating speed thereof and the rotating speed of the drive means for the supercharger are thus avoided.

In Japanese Laid-Open Publication No. 63-170524, it has been proposed to make a supercharging apparatus for an internal combustion engine having both a screw type supercharger and a turbocharger such that the capacity of the screw type supercharger is reduced to decrease the pumping loss when the engine is operated in partial load conditions. That is, in this conventional supercharging apparatus, the screw type supercharger has control valves which are slideable axially, and its intake air inlet is adapted to be opened by the control valves in order to reduce the capacity of the supercharger.

This type of supercharger might be able to reduce the pumping loss in low load or partial load operating conditions to some extent. However the compression action thereof still remains, and therefore, since the idle rotation of the supercharger is limited during its disengagement with the drive means, the torque shock occurs upon an engagement with the drive means for the supercharger owing to a considerable variation in the engine torque.

SUMMARY OF THE INVENTION

One object of the present invention is to provide a supercharging apparatus for an internal combustion engine that can prevent the engine from causing a torque shock owing to a considerable variation in the torque as a supercharger operatively engages with drive means for the supercharger.

Another object of the present invention is to provide a supercharging apparatus for an internal combustion engine that can ensure that the engine applies the desired torque during a transition period in which relatively quick acceleration of the engine speed is performed and that a supercharger comes into operative engagement with drive means for the supercharger.

Still another object of the present invention is to provide a supercharging apparatus for an internal combustion engine that can ensure the desired flow of intake air relative to the engine and good response during a transition period in which relatively quick acceleration of the engine speed is performed but the supercharger remains held in disengagement with drive means for the supercharger.

The foregoing and other objects and advantages are attained, according to the present invention, by a supercharging apparatus for an internal combustion engine comprising:

a supercharger having an inlet opening and an outlet opening and adapted to compress intake air relative to the engine in a compression area between the openings;

clutch means for engaging and disengaging the supercharger with drive means for driving the supercharger;

passage means for allowing the intake air to bypass said supercharger, said passage means being provided with valve means for closing the passage means;

relief means for relieving at least partially the compression area of the compression pressure therein; and control means for causing said relief means to relieve the compression during the disengagement of said clutch means and controlling said valve means in association with the relief means.

Preferred embodiments of the invention may have the following additional features:

(1) The control means may cause the valve means to close said passage means at a predetermined period of time when the engine performs an acceleration of, the engine speed increases, and the clutch means engages the supercharger with the drive means.

(2) The control means may cause the valve means to open the passage means at a predetermined period of time when the engine performs an acceleration, the engine speed increases and the clutch means holds the supercharger disengaged from the drive means.

BRIEF DESCRIPTION OF THE DRAWINGS

The above and other objects, advantages and novel features of the present invention will be made more fully apparent from a reading of the following detailed description taken in conjunction with the accompanying drawings, in which.

DESCRIPTION OF THE PREFERRED EMBODIMENT

Figure 1:
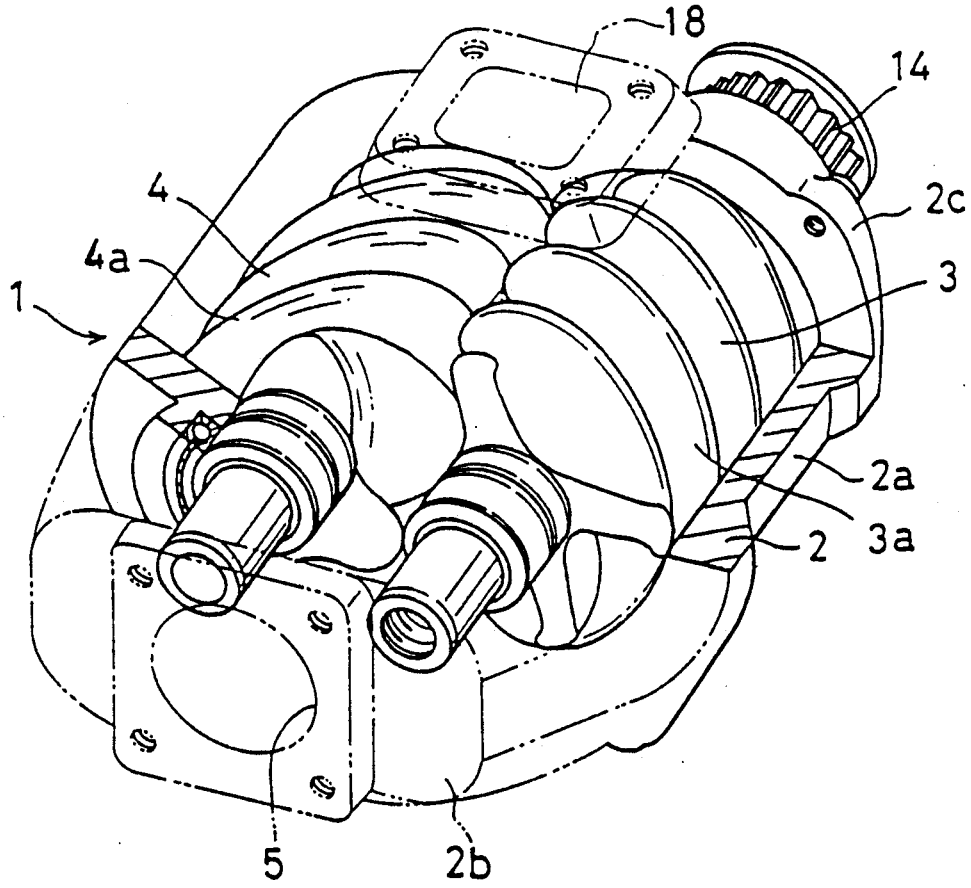
FIG. 1 is a semi-schematic, perspective view showing an embodiment of a supercharger in accordance with the present invention.
Figure 2:
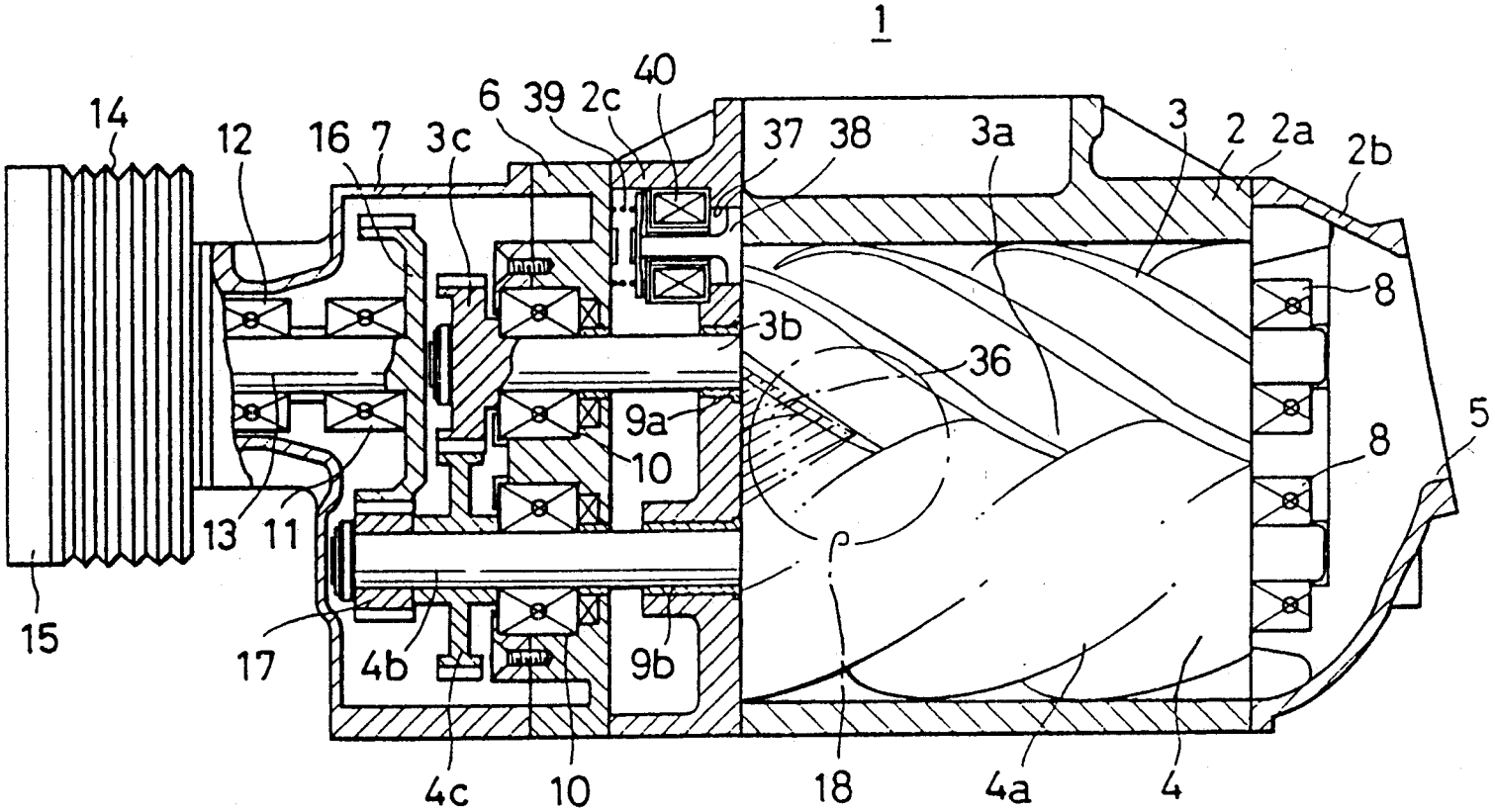
FIG. 2 is a vertical cross-sectional view of the supercharger device shown in FIG. 1.
Figure 3:
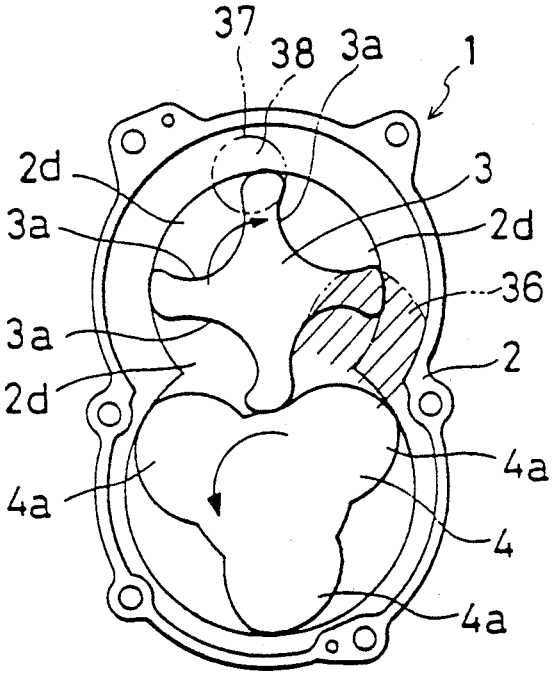
FIG. 3 is a transverse cross-sectional view of the supercharger device shown in FIG. 1.

Referring to FIGS. 1 through 3, there is illustrated a supercharger constituting a supercharging apparatus for an automotive internal combustion engine in accordance with one embodiment of the present invention. The supercharger 1 has a pair of female and male rotors 3, 4, which are disposed in a housing 2. The rotor 3 is provided with helical grooves 3*a* thereon, and the rotor 4 is provided with helical lobes 4*a* thereon. These rotors 3, 4 are positioned in parallel with each other. The grooves 3*a* of the rotor 3 intermesh with the lobes 4*a* of the rotor 4 as shown in FIG. 3. The housing 2 is constituted of a central housing 2*a* and end housings 2*b*, 2*c* which are secured to respective ends of the central housing 2*a*.

As best shown in FIG. 3, the rotors 3, 4 define a plurality of compression chambers 2*d* cooperating with the housing 2. Compression chambers 2*d* constitute compression areas and are rotated as shown by arrows. As shown in FIG. 2, the end housing 2*b* is formed with an intake air inlet opening 5 which opens axially. A bearing plate 6 is secured to the end housing 2*c*, and an end plate 7 is fixed to the bearing plate 6. The rotors 3, 4 have shafts 3*b*, 4*b* respectively, which are rotatably mounted on bearings 8 disposed on the end housing 2*b* at first end portions and rotatably mounted on sleeve bearings 9*a*, 9*b* disposed on the end housing 2*c* and bearings 10 disposed on the bearing plate 6 at second end portions. The shafts 3*b*, 4*b* of the rotors 3, 4 are provided with intermeshing gears 3*c*, 4*c*. A shaft 13 is mounted on the end plate 7 by means of bearings 11, 12 and is concentric with the shaft 3*b* of the rotor 3. A pulley 14 is disposed on the shaft 13, and this pulley 14 is disengagably connected to the shaft 13 through an electromagnetic clutch 15, which is provided on the shaft 13. The shaft 13 has a gear 16, which meshes with a gear 17 on the shaft 4*b* of the rotor 4. The central housing 2*a* is formed with an intake air outlet opening 18 at its end portion close to the end housing 2*c*.

Figure 4:
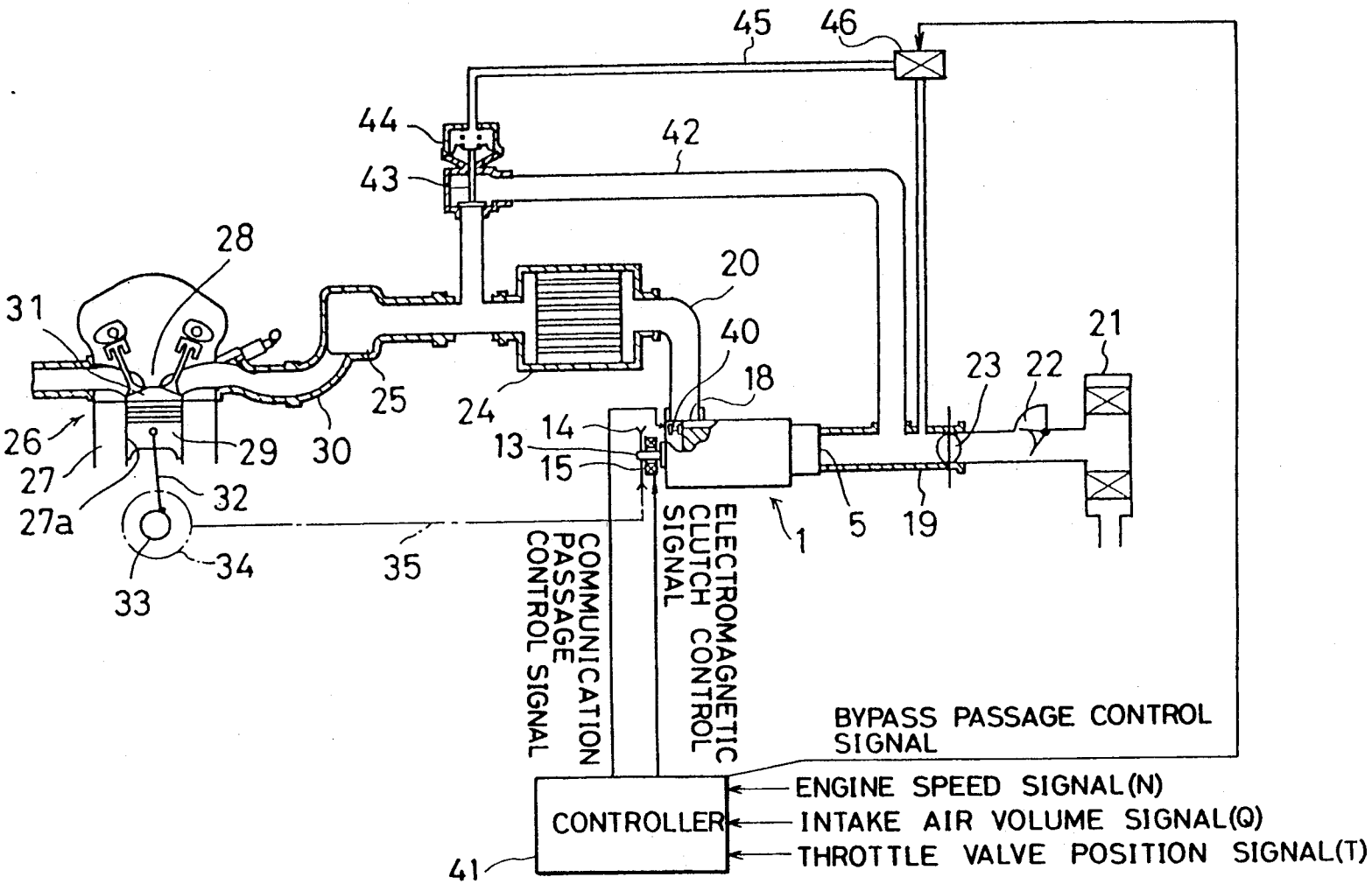
FIG. 4 is a schematic view showing an air intake system of an engine which is provided with the supercharging apparatus in accordance with the present invention.

FIG. 4 illustrates a supercharging apparatus which uses the supercharger 1 shown in FIGS. 1 through 3. With reference to FIG. 4, the intake air inlet opening 5 is connected to an upstream intake air passage 19 and the intake air outlet opening 18 is connected to a downstream intake air passage 20. In the upstream intake air passage 19, there is disposed in succession from the upstream side, an air cleaner 21, an airflow meter 22 and a throttle valve 23. The downstream intake air passage 20 is provided with an intercooler 24 and is formed with a surge tank 25 at its downstream end portion.

An engine 26 has a cylinder block 27 formed with cylinder bores 27*a* and a cylinder head 28 mounted on top of the cylinder block 27. A piston 29 is provided in each of the cylinder bores 27 and in sliding contact with an inside wall of the bore, that is, a cylinder wall 27*a*. The surge tank 25 is in communication with each of combustion chambers 31, defined within the respective cylinder bores 27, through an intake manifold 30 and an intake valve or valves.

Connecting rods 32 are attached at one end to the pistons 29 and at the other end to a crank pin (not shown) of a crankshaft 33. A pulley 34, secured to the crankshaft 33 is operatively connected with the pulley 14 on the shaft 13 of the supercharger 1 by means of an endless belt 35. With this arrangement, the crankshaft 33 of the engine 26 drives the rotors 3, 4 of the supercharger 1 to rotate them during engagement of the electromagnetic clutch 15. When the rotors 3, 4 of the supercharger 1 are driven so as to rotate, rotation of the rotors 3, 4 allows the compression chambers 2*d* defined in the housing 2 to displace circumferentially with respect to the housing, and, therefore, the volume of the chamber 2*d* gradually reduces with the rotation of the rotors 3, 4 so that the intake air therein is compressed. The area 36 shown with shadow lines in FIGS. 2 and 3 is a discharge area for the pressurized or supercharged air. This discharge area 36 is in communication with the intake air outlet opening 18. Accordingly, in the usual operation of the supercharger 1, the intake air introduced through the intake air inlet opening 5 is compressed before reaching the discharge area 36, and is delivered through the air intake outlet opening 18 to the downstream intake passage 20.

Figure 5:
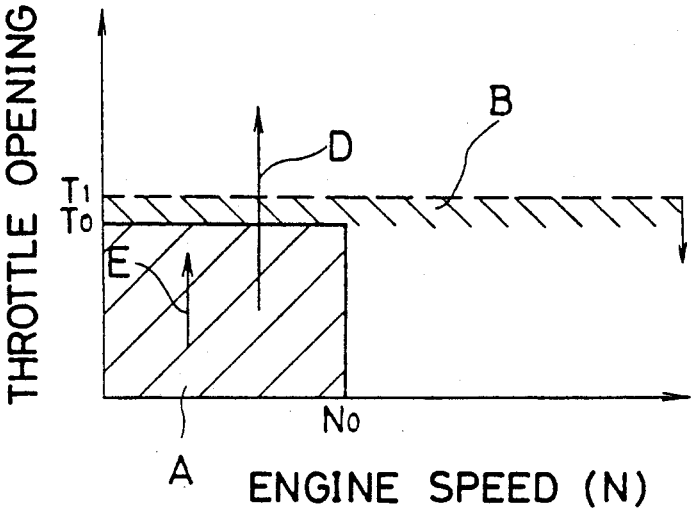
FIG. 5 is a graphical representation showing an illustrative zoning of operating conditions of the engine for controlling opening and closing of a communication passage of the supercharger and operation of an electromagnetic clutch of the supercharger.
Figure 6:
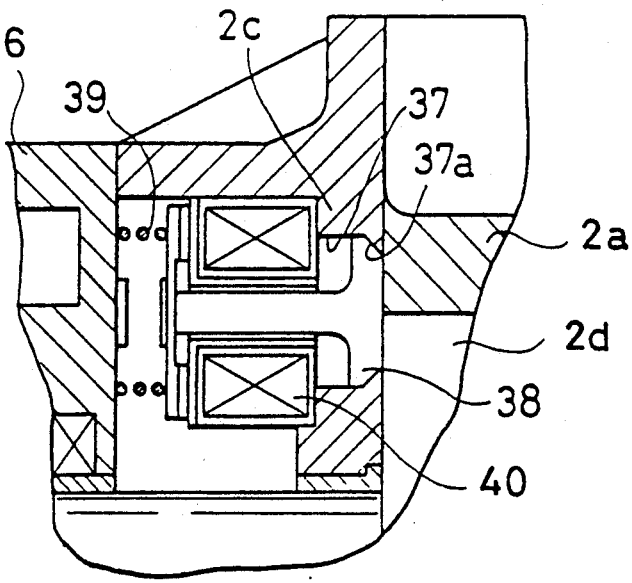
FIG. 6 is a semi-schematic enlarged cross-sectional view showing an arrangement of the communication passage and a valve provided thereon in the supercharger.

FIG. 5 shows the relationship between the control of engagement and disengagement of the electromagnetic clutch 15 and the operating condition of the engine. In FIG. 5, the zone A is an engine operating zone in which the opening of the throttle valve 23, namely, throttle opening T, is smaller than a predetermined value $T_0$ and the engine speed N is lower than a predetermined speed $N_0$, that is, the engine 26 operates under unloaded or low load conditions. When the engine 26 operates within the zone A, the electromagnetic clutch 15 is disengaged or released so that the rotors 3, 4 can rotate freely. Means for depressing or relieving the compressing action of the supercharger 1 under the operating conditions within the zone A is provided so that the running resistance therein is reduced. This means comprises a communication passage 37 formed in the end housing 2*c* and a valve 38 is best shown in FIG. 6. As shown in FIG. 3, the communication passage 37 is formed in a position which allows the two compression chambers 2*d* to intercommunicate at an upstream side of the discharge area 36. Preferably, the communication passage 37 may be provided so that the passage 37 can continue the intercommunication mentioned above until immediately before an advancing compression chamber 2*d* reaches the discharge area 36.

Referring to FIG. 6, the communication passage 37 is provided with a valve seat 37*a* at one end thereof facing the rotor 3. The valve 38 is abutted against the valve seat 37*a* from the outside of the end housing 2*c*. A valve spring 39 biases the valve 38 toward the valve seat 37*a*, so that the valve 38 so as is kept closed. A solenoid 40 is provided for shifting the valve 38 to open it. In order to control the solenoid 40 and the electromagnetic clutch 15, there is provided a controller 41 as shown in FIG. 4. This controller 41 receives, as input signals, an engine speed signal N, an intake air volume signal Q and a throttle valve position signal indicating the throttle opening T and the angular velocity $d\theta/dt$ of the throttle valve 23, respectively on the basis of these signals, the controller 41 discerns whether the present operating condition of the engine 26 is in the zone A as shown in FIG. 5. When the controller 41 discerns that the present operating condition of the engine is in the zone A, it energizes the electromagnetic clutch 15 to disengage or deactivate the clutch 15 by a clutch control signal. Further, when the controller 41 discerns that the present throttle opening T is not more than the predetermined opening value $T_1$, it energizes the solenoid 40, by a communication passage control signal, so as to shift the valve 38 into its open position so that the communication passage 37 is released. The value $T_1$ is indicated in FIG. 5, and is set larger than the value $T_0$ so as not to duplicate the timing of disengaging the electromagnetic clutch 15 and the timing of shifting the valve 38.

As the communication passage 37 is released, the two compression chambers 2*d* come into intercommunication, and the air to be compressed within the leading chamber 2*d* shown on the left side of the communication passage 37 in FIG. 3, flows out into the other following chamber 2*d*, shown on right side of the communication passage 37. Therefore, the pressure of the air in the former chamber 2*d* is reduced to relieve the compressing action.

Referring to FIG. 4, there is provided a bypass passage 42, one end of which is connected to the upstream intake air passage 19 downstream of the throttle valve 23, and the other end of which is connected to the downstream intake air passage 20 downstream of the intercooler 24. A bypass control valve 43 is disposed in the bypass passage 42, and a pneumatic actuator 44 is connected with a valve stem of the control valve 43 for operating the control valve 43. Into the actuator 44, the pressure in the upstream intake air passage 19, downstream of the throttle valve 23, can be introduced through a conduit 45, in which a solenoid-operated three-way control valve 46 is provided. When the three-way control valve 46 takes a position in which the valve 46 allows the actuator 44 to be in communication with the upstream intake air passage 19, the pressure in the passage 19 is introduced into the actuator 44. In this situation, provided that the pressure is lower than a predetermined value, the actuator 44 allows the bypass control valve 43 to open the bypass passage 42. The three-way control valve 46 can take a position in which it allows the actuator 44 to release to the atmosphere, wherein the actuator 44 holds the bypass control valve 43 in its closed position.

Figure 7:
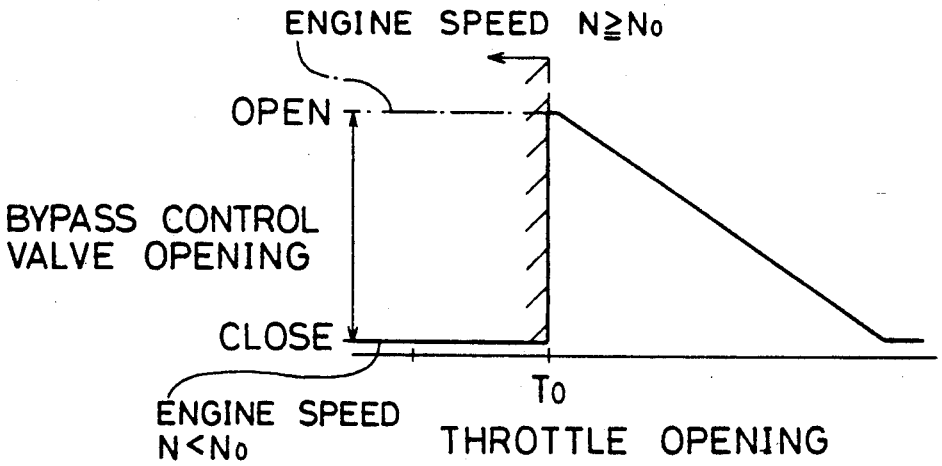
FIG. 7 is a graphical representation showing a manner of controlling a bypass control valve provided in a bypass passage.

As shown in FIG. 4, the output of the controller 41, that is, a bypass passage control signal, is also applied to the three-way control valve 46, so that the valve 46 is controlled in its position by the controller 41. As best shown in FIG. 7, the three-way control valve 46 is released to the atmosphere and the bypass control valve 43 is closed, under an operating condition in which the throttle opening T and the engine speed N (rpm) are smaller than the predetermined values $T_0$ and $N_0$, respectively. On the other hand, under an operating condition in which the throttle opening T is larger than the value $T_0$, the three-way control valve 46 causes the upstream intake air passage 19 to come into communication with the actuator 44, so that the opening of the bypass control valve 43 is under the control of the pressure of the intake air in the intake air passage 19.

Figure 8:
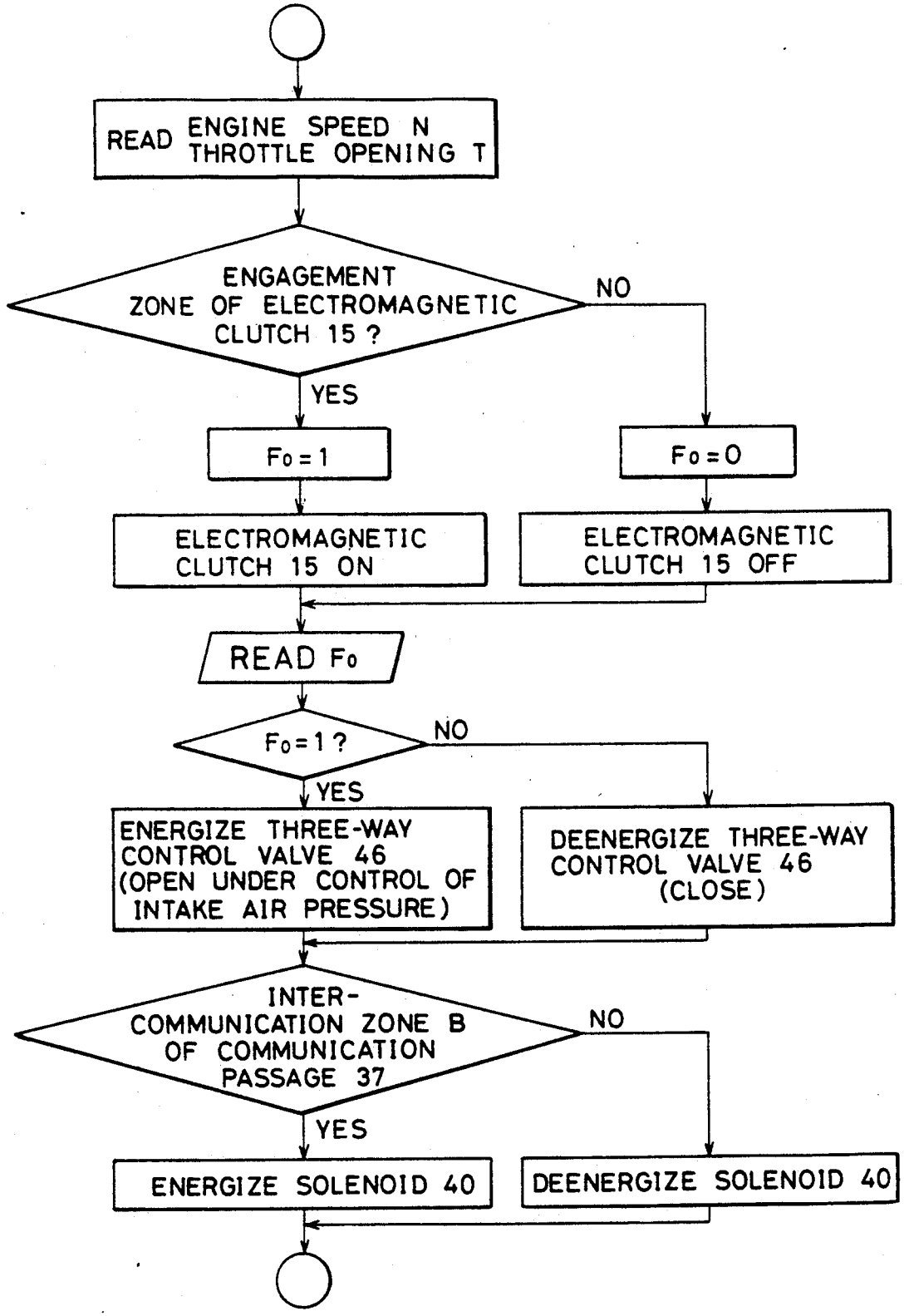
FIG. 8 is a flow chart partially showing the operation of a controller shown in FIG. 4.

FIG. 8 shows steps taken for controlling the electromagnetic clutch 15, the three-way control valve 46 and the solenoid 40.

At the first step, the controller 41 reads the present engine speed N and the throttle opening T of the throttle valve 32. Then, on the basis of the read information, the controller 41 discerns whether the engine 26 operates in an engine operating zone in which the electromagnetic clutch 15 is engaged namely out of the zone A as designated in FIG. 5. If the engine 26 operates out of the zone A, the electromagnetic clutch 15 is deenergized to come into engagement, and a flag $F_0$ is set to "1". When the engine 26 operates in the zone A, the electromagnetic clutch 15 is energized to be in disengagement. The flag $F_0$ is also set into "0".

The position of the flag $F_0$ is then read for controlling the three-way control valve 46, and so long as the flag $F_0$ is positioned at "1", the valve 46 is energized to shift into the position which causes the upstream intake air passage 19 and the actuator 44 to intercommunicate. As a result, the opening of the bypass control valve 43 is under the control of the pressure in the intake air passage 19. Conversely, if the flag $F_0$ is "0", the three-way control valve 46 is deenergized and kept closed. After that, the controller 41 discerns, on the basis of the throttle opening T, whether the engine 26 operates in the engine operating zone B to open the communication passage 37 in the supercharger 1. In other words, the controller 41 determines whether the throttle opening T is or is not more than the predetermined value $T_1$. Provided that the engine 26 operates in the zone B, that is, the opening T is not more than the value $T_1$, the solenoid 40 is energized to open the communication passage 37. On the other hand, if the engine 26 operates out of the zone B, that is, the opening T is more than the value $T_1$, the solenoid 40 is deenergized to close the communication passage 37.

Under this control, the intake air passes through the supercharger 1 during the operation of the engine such that it does not drive the supercharge 1. The flow of the intake air through the supercharger 1 is increased as compared with a case where the bypass passage is opened at this time. Further, the supercharger 1 is relieved of its compression action, so that the resistance relative to idle rotation thereof is greatly lowered. Therefore, the supercharger 1 is substantially freely rotated by the intake air flowing therethrough, and when the electromagnetic clutch 15 is engaged again, differences between the rotating speed of the supercharger 1 and the one of the crankshaft 33 of the engine 26 will have been reduced. Thus, upon re-engagement of the electromagnetic clutch 15, it is possible to prevent the engine 26 from causing a so-called torque shock from a rapid reduction of the engine torque.

Figure 9:
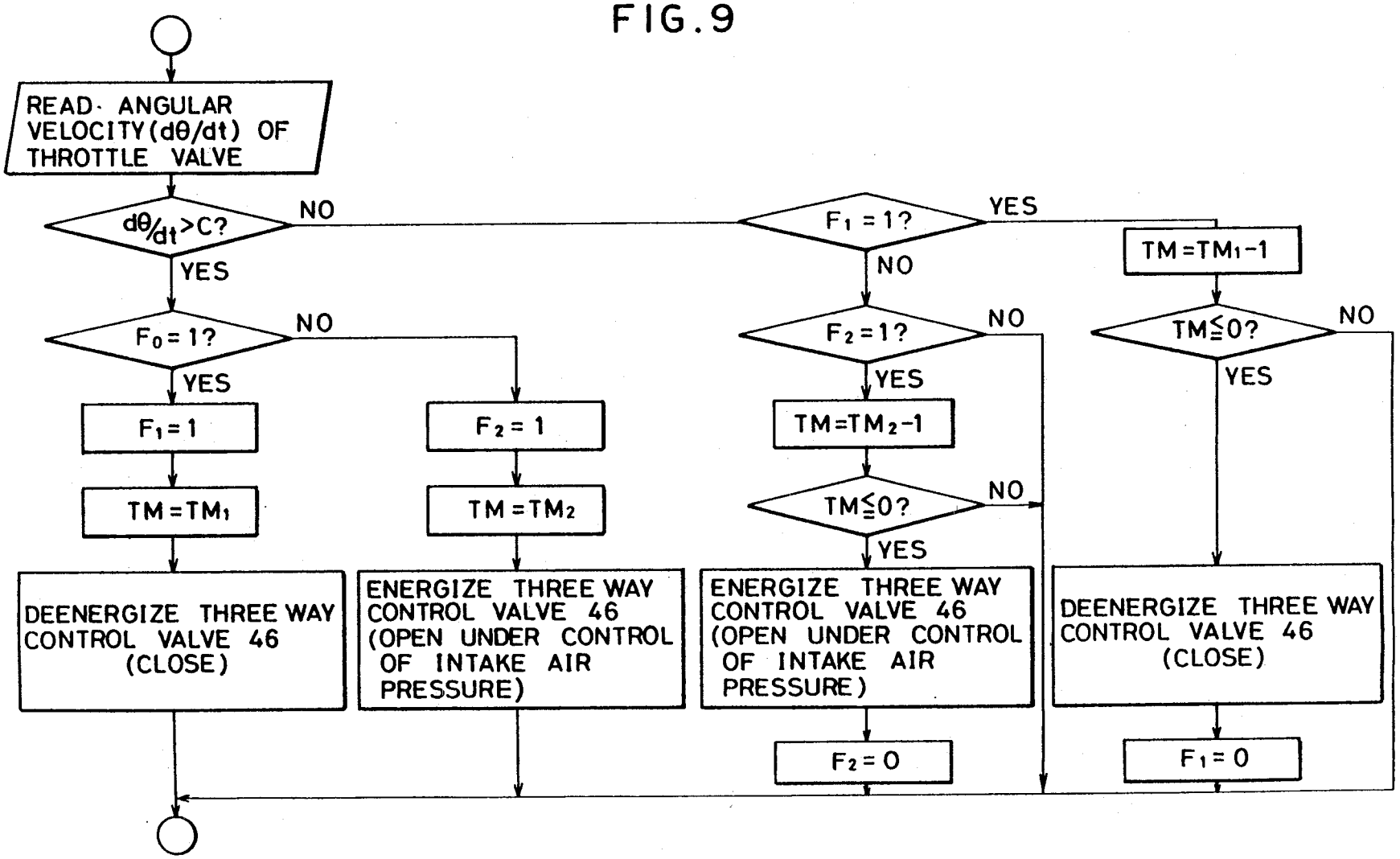
FIG. 9 is a flow chart showing the other part of the operation of the controller.

FIG. 9 shows a manner of control during acceleration. At the first step, the controller 41 reads the position of the flag $F_0$ and the angular velocity $d\theta/dt$ of the throttle valve 23, which corresponds to a driver's push-down operation relative to an accelerator pedal (not shown). Then, the controller 41 discerns whether or not the velocity $d\theta/dt$ is more than a predetermined value C. If the velocity $d\theta/dt$ is more than the value C, the controller 41 further reads the position of the flag $F_0$. When the flag $F_0$ is positioned at "1", the controller sets Flag $F_1$ to "1" and causes a timer TM to terminate at the count $\Delta TM_1$. Further, the controller 41 deenergizes the three-way control valve 46 to keep the bypass control valve 43 in its closed position until the timed term $\Delta TM_1$ expires. Such a manner of control is carried out, in a case in which the throttle opening T rapidly varies upwardly from the zone A to disengage the electromagnetic clutch 15 to the zone B to engage the clutch 15 as shown by an arrow D in FIG. 5, because of a quick push-down operation on the accelerator pedal. In this case as set forth above, the controller 41 discerns the condition of the engine 26 on the basis of the throttle opening T after the push-down operation on the accelerator pedal and the angular velocity $d\theta/dt$ corresponding to the movement of the accelerator pedal during the operation. The controller 41 then carries out the control relative to the bypass control valve 43 to keep the valve 43 in its closed position at the preset period $\Delta TM_1$. Such a control allows the flow of the intake air through the supercharger 1 to increase upon a quick acceleration, so that the output torque of the engine 26 can be enhanced.

When the flag $F_0$ is not positioned at "1", the controller 41 energizes the three-way control valve 46 so that the valve 46 causes the upstream intake air passage 19 to communicate with the actuator 44 for opening the bypass control valve 43, after setting a flag $F_2$ to "1" and setting the timer TM to terminate at the count $\Delta TM_2$. Such a manner of control is carried out when an acceleration is effected so that the throttle opening T does not exceed the zone A to disengage the electromagnetic clutch 15 and, therefore, the throttle opening T remains in the zone A. In this case, as is apparent from the above description, the bypass control valve is forced to be opened at the preset period $\Delta TM_2$, even if the opening T is in the zone A.

Such a control allows the flow of the intake air for the acceleration to be supplied to the engine 26 through the bypass passage 42; this can prevent the engine 26 from retarding the acceleration.

After the push-down operation of the accelerator pedal is accomplished, the angular velocity $d\theta/dt$ usually becomes lower than the value C. In this situation, the controller 41 discerns the position of the flag $F_1$ and, if the flag $F_1$ is set at "1" and the count of the timer TM has passed the preset period $\Delta TM_1$, the controller 41 deenergizes the three-way valve 46 so that the bypass control valve 43 is closed. Further, the controller 41 initializes the flag $F_1$ to "0". If the flag $F_1$ is set at "0", the controller 41 discerns the position of the flag $F_2$ and, provided that the flag $F_2$ is set at "1", energizes the three-way control valve 46 so that the bypass control valve 43 is opened until the timer TM has counted past the preset period $\Delta TM_2$. Further, the controller 41 initializes the flag $F_2$ to "0" and thus completes its control relative to the control valves 43, 46.

As described above with reference to the preferred embodiments, according to the present invention, the supercharging apparatus for the internal combustion engine 26 can be provided. The supercharging apparatus comprises the supercharger 1 having the inlet opening 5 and the outlet opening 18 and being adapted to compress the intake air relative to the engine 26 in the compression chambers **2*d* between the openings, the electromagnetic clutch 15 for engaging the disengaging the supercharger 1 with the crankshaft 33 of the engine 26, the intake air bypass passage 42 for allowing the intake air to bypass the supercharger 1, a bypass control valve 43 provided for closing the passage 42, the communication passage 37 for allowing the two compressing chambers 2*d* to intercommunicate for relieving the compressing chambers 2*d* of the compression pressure therein, and controller 41 for causing the communication passage 37 to relieve the compression pressure during the disengagement of the electromagnetic clutch 15 and causing the bypass control valve 43 to close the intake air bypass passage 42 in association with the relief of the compression pressure by the communication passage 37**.

With this arrangement, the compression pressure is relieved in operating conditions of the engine 26 in which the supercharger 1 is disengaged from the crankshaft 33 of the engine 26 by the electromagnetic clutch 15. It follows that it is easy for the supercharger 1 to idle in these conditions. Further, the bypass control valve 43 is closed over the period when the supercharger 1 is disengaged from the crankshaft 33 in conjunction with the relief of the compression pressure, so that the intake air to be supplied to the engine 26 through the supercharger 1 in that period and, therefore, the flow of the intake air for idly running the supercharger 1 can be increased. Thus, the differences between the rotating speed of supercharger 1 and of the engine 26 can be reduced, and this can prevent the engine 26 from causing considerable torque variations. Thus, a torque shock, upon the engagement of the electromagnetic clutch 15 is prevented.

Further, according to the above embodiment, the bypass control valve 43 is operated to close the intake air bypass passage 42 at a predetermined period of time, when the engine 26 performs an acceleration and increases its speed and the electromagnetic clutch 15 engages the supercharger 1 with the crankshaft 33. Therefore, under such conditions, it is possible to increase the flow of the intake air through the supercharger 1 so that the supercharger 1 can attain the desired supercharging so that the engine 26 can develop the required torque.

Still further, the bypass control valve 43 is operated to open the intake air bypass passage 42 at a predetermined period of time, when the engine 26 performs an acceleration and increases its speed and the electromagnetic clutch 15 disenages the supercharger 1 from the crankshaft 33. This allows the intake air required for the acceleration to be supplied to the engine 26 through the bypass passage 42, which ensures the desired acceleration of the engine 26.

Figure 7A:
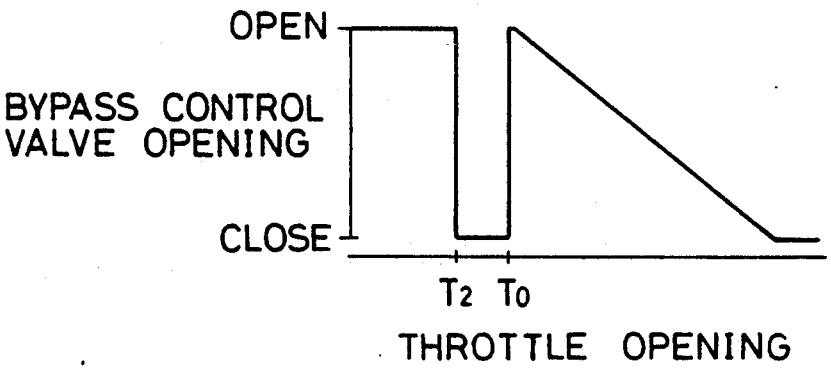
FIG. 7A is a graphical representation showing an alternative manner of controlling the bypass control valve.

FIG. 7A illustrates an alternative manner of controlling the bypass control valve 43. In this particular application, the bypass control valve 43 is closed during a certain period of the throttle opening T, immediately before the throttle opening T reaches the value $T_0$. In other words, the bypass control valve 43 is closed so long as the throttle opening T exceeds the predetermined value $T_2$ and still remains below the value $T_0$. With this arrangement, the flow of intake air passing through the bypass passage 42 is more than the first embodiment described above under the low load operating conditions of the engine 26. Therefore it is possible to minimize the work which is done to idly run the supercharger 1 to reduce the difference between the rotating speed thereof and the one of the crankshafts 33.

The present invention has thus been shown and described with reference to specific embodiments. However, it should be noted that the present invention is in no way limited to the details of the described arrangement changes and modifications may be made without departing from the scope of the appended claims.

For example, in the above embodiments, the supercharging apparatus uses a screw type supercharger, but the supercharging apparatus may use a roots type supercharger.

What is claimed is:

1. A supercharging apparatus for an internal combustion engine comprising:

a supercharger having an inlet opening and an outlet opening and being adapted to compress intake air relative to the engine in a compression area between the inlet opening and the outlet opening;

clutch means for engaging the supercharger with and disengaging the supercharger from driver means for driving the supercharger;

passage means for allowing the intake air to bypass said supercharger, said passage means being provided with valve means for closing the passage means;

relief means for at least partially relieving compression pressure in said compression area; and control means for controlling said relief means and said valve means so that when said clutch means disengages the supercharger from the drive means, the relief means relieves the compression pressure and the valve means closes said passage means.

2. An apparatus according to claim 1, wherein said control means causes said valve means to close said passage means for a period before said clutch means causes said supercharger to engage with the drive means.

3. An apparatus according to claim 1, wherein said control means causes said valve means to close said passage means when an engine speed is smaller than a predetermined engine speed and causes said valve means to open said passage means when an engine speed is larger than the predetermined engine speed.

4. An apparatus according to claim 1, wherein said control means causes said valve means to close said passage means at a predetermined period of time when the engine performs an acceleration and increases an engine speed and said clutch means engages said supercharger with said drive means.

5. An apparatus according to claim 1, wherein said control means causes said valve means to open said passage means at a predetermined period of time when the engine performs an acceleration and increases an engine speed and said clutch means holds said supercharger disengaged from said drive means.

6. An apparatus according to claim 1, wherein said control means causes said valve means to close said passage means at a predetermined period of time when the engine performs an acceleration and increases an engine speed and said clutch means engages said supercharger with said drive means, and said control means causes said valve means to open said passage means at a predetermined period of time when the engine performs an acceleration and increases an engine speed and said clutch means holds said supercharger disengaged from said drive means.

7. An apparatus according to claim 1, wherein said clutch means causes said supercharger to disengage from the drive means on the basis of a throttle opening and engine speed, and said control means causes said relief means to relieve the compression pressure depending on the throttle opening.

8. An apparatus according to claim 7, wherein said control means causes said relief means to relieve the compression pressure when the throttle opening is larger than a predetermined value, the predetermined value being set larger than a predetermined throttle opening at which said clutch means causes said supercharger to disengage from the drive means.

9. An apparatus according to claim 1, wherein said supercharger comprises a screw supercharger having intermeshing helical rotors on parallel axes and mounted on a housing.

10. An apparatus according to claim 9, wherein said compression area includes a plurality of compression chambers separated from each other and said relief means allows the plurality of compression chambers to intercommunicate.

11. An apparatus according to claim 10, wherein said relief means comprises communication passage means for allowing the compression chambers to intercommunicate when the compression chambers do not communicate with the outlet opening of the supercharger.

12. An apparatus according to claim 11, wherein said communication passage means is provided with a passage disposed to allow the compression chambers to intercommunicate the valve means for opening and closing the passage.

13. An apparatus according to claim 12, wherein said valve means has a spring biased valve disposed in the passage and a solenoid for shifting the valve to open the passage.

14. An apparatus according to claim 12, wherein said passage is formed in an housing of said supercharger.

15. An apparatus according to claim 1, wherein said passage means comprises a bypass passage which is connected at its ends to an air intake passage communicating with said outlet opeing and said inlet opening, respectively of the supercharger.

16. An apparatus according to claim 15, wherein said valve means comprises a valve and a pneumatic actuator operatively connected thereto, the acutuator communicating with said air intake passage through a passage and a means for closing the passage.

17. An apparatus according to claim 16, wherein said actuator is adapted to displace said valve under control of pressure in said air intake passage.

* * * * *